United States Patent [19]

Weschenfelder et al.

[11] Patent Number: 4,519,594

[45] Date of Patent: May 28, 1985

[54] FORMER FOR A FOLDER IN A WEB-FED ROTARY PRINTING PRESS

[75] Inventors: Otto T. Weschenfelder; Günter K. Schmitt, both of Würzburg, Fed. Rep. of Germany

[73] Assignee: Koenig & Bauer Aktiengesellschaft, Fed. Rep. of Germany

[21] Appl. No.: 591,081

[22] Filed: Mar. 19, 1984

[30] Foreign Application Priority Data

Mar. 24, 1983 [DE] Fed. Rep. of Germany ..... 3310746

[51] Int. Cl.[3] ..... B41F 13/56

[52] U.S. Cl. ..... 270/20.1

[58] Field of Search ..... 270/20.1, 4, 6, 42, 270/8

[56] References Cited

U.S. PATENT DOCUMENTS 1,868,880 7/1932 Brueshaber ..... 270/8
2,107,462 2/1938 Wood ..... 270/37

FOREIGN PATENT DOCUMENTS 3136882 4/1982 Fed. Rep. of Germany ..... 270/20.1
85432 7/1978 Japan ..... 270/20.1

*Primary Examiner*—E. H. Eickholt
*Attorney, Agent, or Firm*—Jones, Tullar & Cooper

[57] ABSTRACT

A former assembly for a folder in a web-fed rotary printing press is disclosed. The former assembly includes a paper guide spaced between side frames which are supported for rotation about a vertical axis above a group of folder cylinders. An upper carrousel is used to support the side frames while a carrousel base is carried by the folder. A steering ring is interposed between the upper carrousel and carrousel base to allow rotation of the upper carrousel with respect to the base. Suitable locks are provided to fix the former assembly at desired points along its rotational path above the folder cylinders.

4 Claims, 5 Drawing Figures

FORMER FOR A FOLDER IN A WEB-FED ROTARY PRINTING PRESS

FIELD OF THE INVENTION

The present invention is directed generally to a former for a folder. More particularly, the present invention is directed to a former for a folder in a web-fed rotary printing press. Most specifically, the present invention is directed to a former assembly that is rotatable about a vertical axis and is placed above a group of folder cylinders. The former assembly, which includes upper support frames and guide rollers, is supported on a horizontally disposed steering ring and is rotatable on the steering ring through at least a 180° arc. The rotatable former assembly in accordance with the present invention includes locking means so that the folder can be secured in a "0° position" and in a "180° position". By use of the former of the present invention, the paper web, which may be printed in multiple colors, can be presented to the folder with the color printing oriented to be either on the outside or the inside of the folded product.

DESCRIPTION OF THE PRIOR ART

In web-fed rotary printing presses having a plurality of paper webs and a number of printing units, some of which are capable of multi-color printing, it has frequently been desirable to have the multi-color paper web arrive at the inlet of the former or folder with the paper web oriented so that the multi-color surface enters the inlet either from above or below. Depending on the type of former being used, the multi-color printed surface of the paper web, or another surface of the web having specific printing on its surface may require forming or folding so that a selected web surface is either on the inside or the outside of the folded product.

In prior art devices, the need to have a particular web surface arrive at the inlet of the folder or former from either above or below; i.e. with the specific surface visible from either above or below the web, has required a complicated arrangement of paper web guides and turning arrangements. These complex arrangements have been difficult to operate, have required time consuming and hence costly set up procedures, and have been bulky and cumbersome. These prior art devices required to change the imposition schedule of the paper web to the former and folder have thus been less than completely satisfactory.

SUMMARY OF THE INVENTION

It is an object of the present invention to provide a former assembly for a folder in a web-fed rotary printing press.

Another object of the present invention is to provide a former in which the former is rotatable about a vertical axis.

A further object of the present invention is to provide a former in which the printed web can come to the former inlet from either above or below.

Yet another object of the present invention is to provide a former wherein the printed web may be set to the inside or outside of the folded product.

A still further object of the present invention is to provide a former which allows expansion and variation of the imposition schedule in a simple manner.

As will be discussed in greater detail in the description of the preferred embodiment, as set forth hereinafter, the former for a folder in accordance with the present invention includes a former assembly means such as a roller which is secured between upper side frames that are, in turn, attached to an upper carrousel by a plurality of upper struts. This upper carrousel is rotatably supported on, and slides with respect to a generally horizontal steering ring. The upper side frames and forming assembly can thus be rotated through an arc of at least 180° about a vertical axis which extends upwardly from the folder. By rotating the former and its associated paper web guide rollers, the paper web can be directed to arrive at the inlet to the folder with a desired side of the web either facing upwardly or downwardly. This arrival of the web from either above or below allows the web to be folded so that the desired web surface is set to either the inside or the outside of the folded product.

A particular advantage of the former for a folder in accordance with the present invention resides in the flexibility which is provides. The web-fed rotary printing press with which the former for a folder in accordance with this invention is used can now be used for the production of newspapers (with the pin holes at the bottom end of the newspaper) or can be used for more complex, multi-color printing as is frequently required in job printing. The complex and complicated paper web guides and turning arrangements previously required are no longer necessary. In multi-color printing in which as many as four or more different colors may be printed on one side of the web, it is not necessary for the side of the web printed with the multiple colors to run in contact with the paper guide rollers prior to arrival at the former. Thus color smears and the like, which may occur if the newly printed web surface contacts the paper guide rollers, are eliminated. By selecting the orientation of the former portion of the folder and by securing the former in the selected position, the desired web surface can be oriented to the inside or outside of the folded product. Thus it may be seen that the former for a folder in accordance with the present invention provides a former which does away with the previously required complex and complicated paper web guides and turning arrangements hitherto necessitated to accomplish desired web orientations.

BRIEF DESCRIPTION OF THE DRAWINGS

While the novel features of a former for a folder in a web-fed rotary printing press in accordance with the present invention are set forth with particularity in the appended claims, a full and complete understanding of the invention may be had by referring to the detailed description of the preferred embodiment as is set forth hereinafter, and as may be seen in the accompanying drawings in which:

DESCRIPTION OF THE PREFERRED EMBODIMENT

Figure 1:
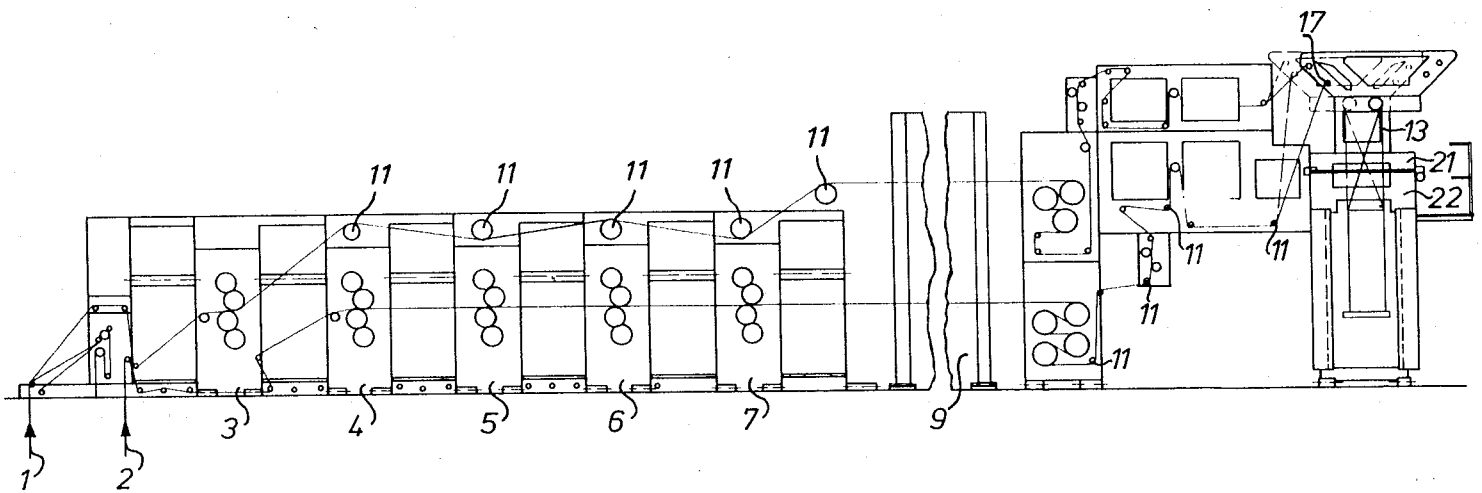
FIG. 1 is a schematic side elevation view of a web-fed rotary printing press in line with a former in a folder in accordance with the present invention.

Referring initially to FIG. 1, there may be seen an overall view of a web-fed rotary printing press in line with a former for a folder in accordance with the present invention. A plurality of webs, such as those designated at 1 and 2, are printed by passing through several printing units, such as the five printing units indicated generally at 3, 4, 5, 6, and 7. Paper web 1 may be printed, for example, in only one color while paper web 2 may be printed in recto and verso in a plurality of colors. After the webs have been printed in a known manner, they are then fed through a suitable paper web dryer 9 by means of suitable guide rollers 11. After leaving dryer 9, the webs are conveyed to a former assembly, generally at 12, in accordance with the present invention in a folder, generally at 13.

Former assembly 12 includes a plurality of paper web guide rollers 11 mounted between spaced upper side frames 14 and 16 in any conventional manner. As may be seen most clearly in FIG. 2, side frames 14 and 16 extend upwardly, are not symetric about a vertical axis, and also can carry driven drag rollers as well as the paper guide rollers. The former assembly 12 includes a generally known former means and is rotatable through at least a 180° arc about the vertical axis shown in FIG. 2. By comparing the positions assumed by the side frames 14 and 16 in FIGS. 1 and 2, it can be seen that the former assumes one orientation when in the position shown in solid lines in FIG. 2 and a second orientation when in the position indicated by the solid lines in FIG. 1. The dashed lines in these two figures indicate the alternate former positions. When former 12 is oriented as seen in FIG. 2, the webs enter the former with the upper print surface entering from above, while in the position shown in FIG. 1, the upper print surface leaving dryer 9 arrives at the former with the print surface entering from below or on the bottom surface of the web.

Figure 2:
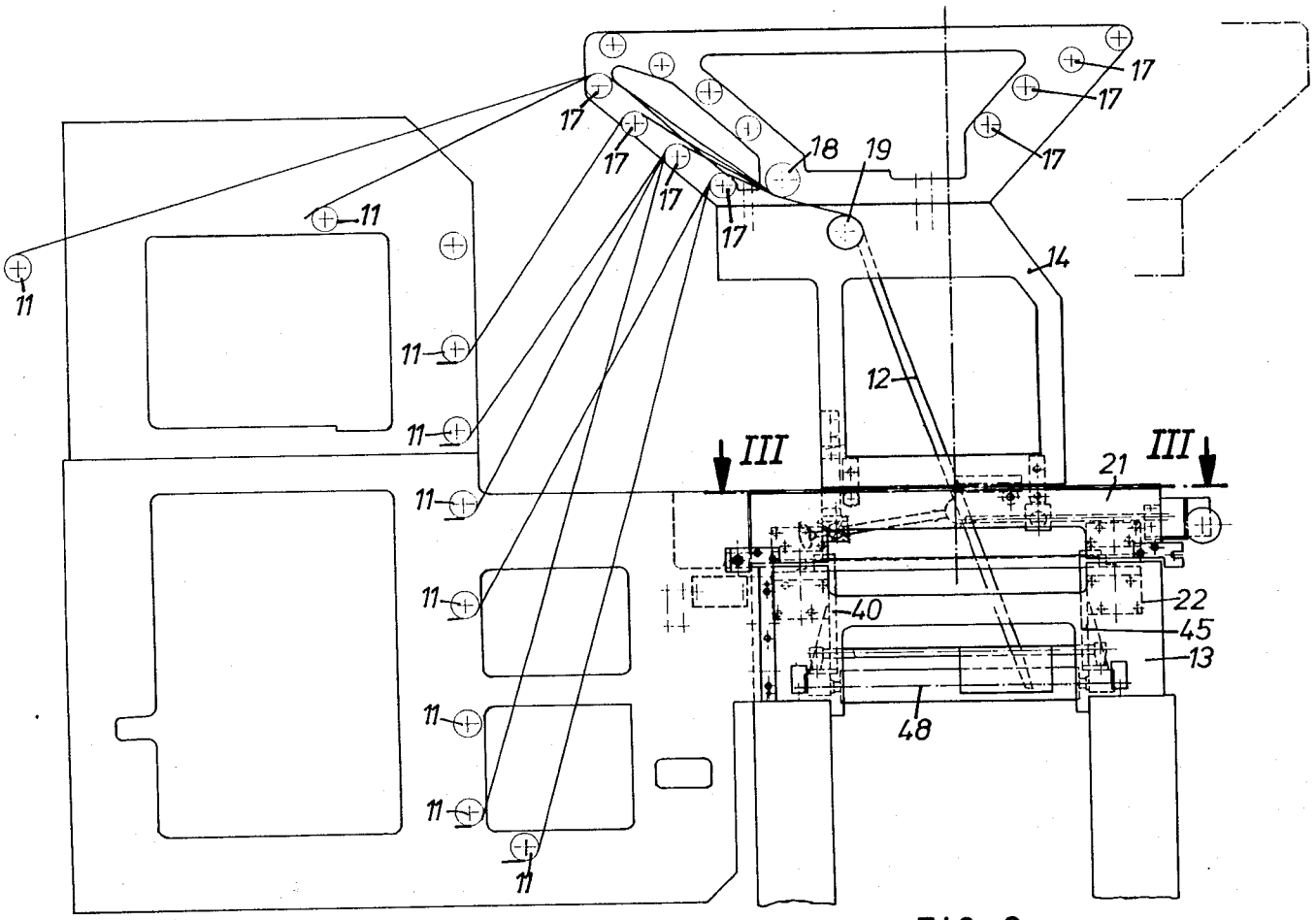
FIG. 2 is a side elevation view of the former in accordance with the present invention and showing the paper web guide mounted thereto.
Figure 3:
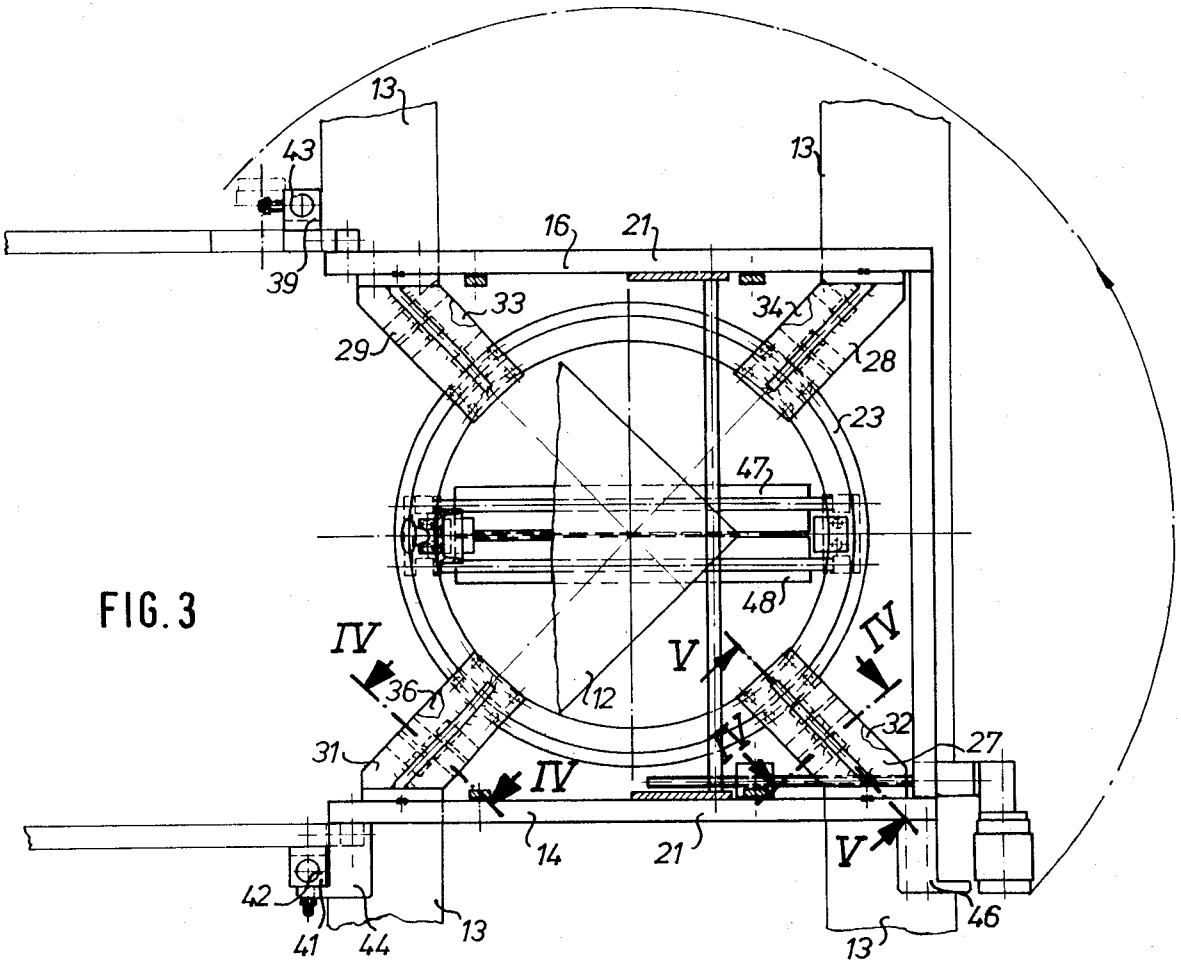
FIG. 3 is a top plan view, partly in section, of the former and taken along line III—III of FIG. 2.
Figure 5:
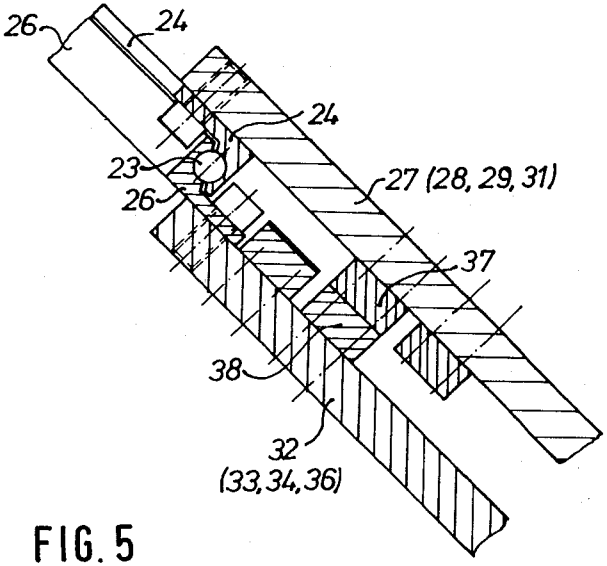
FIG. 5 is a longitudinal sectional view of a support strut taken along line V—V of FIG. 3.

Referring now to FIGS. 2 and 3, side frames 14 and 16 are secured by screws or the like to an upper carrousel part 21. This upper carrousel 21 in turn rests on, and is rotatable with respect to a lower carrousel part 22. Rotation of the upper carrousel 21 with respect to lower carrousel 22 is accomplished by the use of a horizontally positioned steering ring 23. Upper carrousel 21 is secured to an upper ring 24 which is carried by the steering ring 23, as seen in FIG. 5 while a lower ring 26 that is also in contact with the steering ring 23 is secured to the lower carrousel base 22. Four spaced upper struts 27, 28, 29, and 31 extend radially outwardly from the upper ring 24 and are joined to the side frames 14 and 16 at their outboard ends. Four similarly spaced lower struts 32, 33, 34, and 36 are attached to the carrousel base 22 and extend to the lower ring 26 thereby securely attaching the lower ring 26 to the carrousel base 22.

The former 12 can be rotated about a vertical axis by sliding movement of the upper carrousel part 21 with respect to the lower carrousel base 22 on the steering ring 23. A rotation through an arc of at least 180° is afforded so that the former 12 can be moved between the alternate positions shown in FIGS. 1 and 2.

Figure 4:
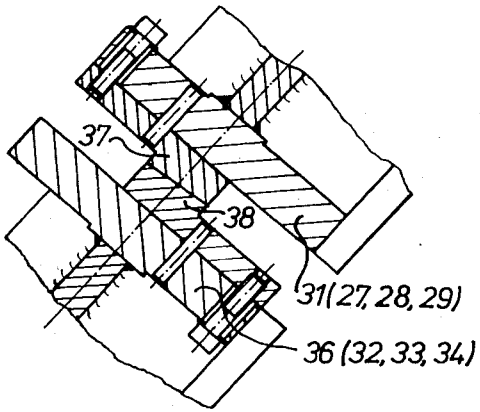
FIG. 4 is a cross sectional view of one of the support struts of the former of the present invention, taken along line IV—IV in FIG. 3.

The former 12 is held in either a "0° position" such as shown in FIG. 2 or a "180° position" such as shown in FIG. 1. This is accomplished by the cooperation of wedges and locks as will now be described. Upper run-up wedges 37 are secured to the underside of upper struts 27, 28, 29, and 31 while lower run-up wedges 38 are attached to the upper surfaces of lower struts 32, 33, 34, and 36, as may be seen in FIG. 5. These wedges 37 and 38 have angled or inclined exposed wedging surfaces, as seen in FIG. 4, which cooperate to support the former on the carrousel base 22 when the former is in either the "0° position" or the "180° position". Locking devices, shown generally at 39 and 41 in FIG. 3, insure that the former 12 will stay in either of the desired positions. Lock blocks 42 and 43 are secured to opposite sides of the carrousel base 22. Each of these lock blocks 42, 43 includes a tapped hole (not shown). A pair of locking arms 44 and 46 are attached at opposite ends of side frame 14. Each locking arm 44, 46 includes a bore hole, (not shown) through which a suitable screw or bolt can be passed for reoeipt in the tapped hole in the lock blocks 42 and 43. As may be seen in FIG. 3, lock arm 44 lies adjacent lock block 42 to form lock assembly 41 when the upper carrousel 21 is in a first position. Rotation of upper carrousel 21 and former 12 through an arc of 180° about a vertical axis will bring lock arm 46 into engagement with lock block 43 to thereby form lock assembly 39. It will be understood that while the lock means 39 and 41 are used to hold the upper carrousel 21 in one of the two desired locations, that it is the cooperation of the upper and lower wedges 37 and 38 which actually support the former once the desired position has been arrived at.

A pair of generally known former guide cylinders 47 and 48 are rotatably supported at their ends between spaced vertical fastening plates 40 and 45 that are carried by the upper carrousel part 21. Since upper carrousel part 21 rotates, these two guide cylinders 47 and 48 also change position as the former 12 is rotated between its "0° position" and its "180° position". Thus the paper webs which have been printed in the several printing units 3, 4, 5, 6, and 7, dried in the dryer 9, and formed by the former 12 are folded by passage between the guide cylinders 47 and 48. As has been discussed previously, the rotatability of former 12 allows the paper web path to be varied thereby orienting a selected surface of the printed webs so that the printing can be received at the guide cylinders and directed to the folder either set to the outside or inside of the folded product.

While a preferred embodiment of a former for a folder in a web-fed rotary printing press in accordance with the present invention has been fully and completely set forth hereinabove, it will be obvious to one of skill in the art that a number of changes in, for example, the number of paper webs and printing units, the various roller support means, the type of folder and the like could be made without departing from the true spirit and scope of the invention and that the invention is accordingly to be limited only by the appended claims.

We claim:

1. A former assembly for a folder in a web-fed rotary printing press, said former assembly comprising:

a pair of spaced side frames rotatably supported for rotation along a path about a generally vertical axis above a group of folder cylinders;

former means supported between said spaced side frames; and locking means for securing said spaced side frames at spaced points along said path of rotation.

2. The former assembly of claim 1 wherein said side frames are secured to an upper carrousel, wherein said folder supports a carrousel base and further wherein a steering ring is positioned between said upper carrousel and said carrousel base.

3. The former assembly of claim 1 wherein a plurality of paper guide rollers are secured between said side frames.

4. The former assembly of claim 2 wherein a plurality of paper guide rollers are secured between said side frames.

* * * * *